US011085327B2

(12) United States Patent
Jungmann

(10) Patent No.: US 11,085,327 B2
(45) Date of Patent: Aug. 10, 2021

(54) MOUNTING PORTION FOR AN EXHAUST GAS TURBOCHARGER, AND EXHAUST GAS TURBOCHARGER

(71) Applicant: IHI Charging Systems International GmbH, Amt Wachsenburg OT Ichtershausen (DE)

(72) Inventor: Gerhard Jungmann, Gorxheimertal/Trösel (DE)

(73) Assignee: IHI Charging Systems International GmbH, Amt Wachsenburg OT Ichtershausen (DE)

( * ) Notice: Subject to any disclaimer, the term of this patent is extended or adjusted under 35 U.S.C. 154(b) by 105 days.

(21) Appl. No.: 16/487,873

(22) PCT Filed: Mar. 29, 2018

(86) PCT No.: PCT/EP2018/000143

§ 371 (c)(1),
(2) Date: Aug. 22, 2019

(87) PCT Pub. No.: WO2018/188777

PCT Pub. Date: Oct. 18, 2018

(65) Prior Publication Data

US 2020/0056504 A1 Feb. 20, 2020

(30) Foreign Application Priority Data

Apr. 13, 2017 (DE) ..... 10 2017 108 100.3

(51) Int. Cl.

| | |
|---|---|
| ***F01D 25/12*** | (2006.01) |
| ***F01D 25/14*** | (2006.01) |
| *F02B 39/00* | (2006.01) |

(52) U.S. Cl.

CPC ..... *F01D 25/125* (2013.01); *F01D 25/14* (2013.01); *F02B 39/005* (2013.01);
(Continued)

(58) Field of Classification Search

CPC ..... F01D 25/125; F01D 25/14; F01D 25/12; F02B 39/005; F05D 2220/40;
(Continued)

(56) References Cited

U.S. PATENT DOCUMENTS 9,476,319 B2 * 10/2016 Bogner ..... F04D 29/4206
9,546,568 B2 * 1/2017 Kanzaka ..... F02B 39/005
(Continued)

FOREIGN PATENT DOCUMENTS

DE 102008011257 A1 9/2009
DE 102008011258 A1 9/2009
(Continued)

*Primary Examiner* — Eldon T Brockman
(74) *Attorney, Agent, or Firm* — Smartpat PLC

(57) ABSTRACT

A bearing section for an exhaust turbocharger comprises a receiving opening for receiving a shaft of a rotor assembly of the exhaust turbocharger. The bearing section is designed for positioning bearing elements for supporting the shaft. A lubricant circuit is designed for supplying lubricant to the bearing elements. Lubricant channels are formed in the bearing section. In order to reduce a component temperature of the bearing section, a cooling jacket is provided, through which coolant can flow. The cooling jacket comprises a coolant channel, an inlet channel and an outlet channel. The inlet channel issues at a first opening point into the coolant channel and the outlet channel is connected at a second opening point to the coolant channel in such a way that a flow can pass therethrough. A rib is provided in the coolant channel.

7 Claims, 4 Drawing Sheets

(52) U.S. Cl.
CPC .... *F05D 2220/40* (2013.01); *F05D 2240/126* (2013.01); *F05D 2260/221* (2013.01)

(58) Field of Classification Search
CPC ..... F05D 2240/126; F05D 2260/221; F05D 2260/232
See application file for complete search history.

(56) References Cited

U.S. PATENT DOCUMENTS

| | | | | |
|---|---|---|---|---|
| 2003/0039537 | A1 | 2/2003 | Itzel et al. | |
| 2011/0008158 | A1* | 1/2011 | Boening | F02C 6/12 415/200 |
| 2013/0209268 | A1 | 8/2013 | Bregman et al. | |
| 2013/0315712 | A1* | 11/2013 | Bogner | F04D 29/584 415/116 |
| 2014/0090375 | A1* | 4/2014 | Kanzaka | F02B 39/005 60/605.3 |

FOREIGN PATENT DOCUMENTS

| | | | |
|---|---|---|---|
| DE | 102011003906 | A1 | 8/2012 |
| DE | 102015105218 | A1 | 10/2016 |
| EP | 1288442 | B1 | 3/2003 |
| JP | H0579344 | A | 3/1993 |

* cited by examiner

MOUNTING PORTION FOR AN EXHAUST GAS TURBOCHARGER, AND EXHAUST GAS TURBOCHARGER

TECHNICAL FIELD

The disclosure relates to a bearing section for an exhaust turbocharger and to an exhaust turbocharger.

BACKGROUND

Bearing sections for exhaust turbochargers are known. The bearing section serves to support a rotor assembly of the exhaust turbocharger, comprising a compressor wheel and a turbine wheel which is connected with the aid of a shaft to the compressor wheel for conjoint rotation therewith. The bearing section has different bearings for supporting the shaft. Typically, slide bearings are provided both for axial support and radial support. Furthermore, roller bearings can also be used to provide further, friction-optimized support. The bearing section is arranged between an air conducting section which receives the compressor wheel and an exhaust gas conducting section which receives the turbine wheel.

Nowadays, exhaust turbochargers are preferably used in virtually all motor vehicles, irrespective of whether an internal combustion engine of the motor vehicle is a diesel engine or a spark-ignited engine. On account of the continuous development of internal combustion engines, in particular towards lower consumption, internal combustion engines now have very high exhaust gas temperatures which, on entering the exhaust gas conducting section of the exhaust turbocharger, have not undergone a significant drop in temperature.

Since the exhaust gas temperatures cause the exhaust gas conducting section to heat up and this in turn results in the bearing section heating up by reason, inter alia, of wall heat transitions, in particular the bearing section which is designed such that lubricant for bearing lubrication can flow therethrough must be cooled.

To this end, cooling water jackets are provided which, either cast-in or formed by means of sheet metal jackets, flow through the bearing section and/or exhaust gas conducting section.

Laid-open document DE 10 2008 011 258 A1 discloses a bearing section for an exhaust turbocharger, the water jacket of which is formed with the aid of a sheet metal jacket which is designed such that it at least partially encompasses the bearing section and the turbine housing. It can be problematic to seal the sheet metal jacket to prevent leakage of the cooling water.

The object of the present invention is now to provide a bearing section of an exhaust turbocharger with an improved cooling water jacket. The further object is to provide an improved exhaust turbocharger.

SUMMARY

This object is achieved by a bearing section for an exhaust turbocharger as claimed. The further object is achieved by an exhaust turbocharger as claimed. Advantageous embodiments with expedient and non-trivial developments of the invention are specified in the dependent claims.

A bearing section for an exhaust turbocharger has a receiving opening for receiving a shaft of a rotor assembly of the exhaust turbocharger. The bearing section is designed for positioning bearing elements for support of the shaft, wherein, in order to supply lubricant to the bearing elements, a lubricant circuit is formed at least partially in the bearing section. In order to reduce the component temperature of the bearing section, a cooling jacket is provided, through which coolant can flow. The cooling jacket comprises a coolant channel, an inlet channel and an outlet channel. The inlet channel issues at a first opening point into the coolant channel and the outlet channel is connected at a second opening point to the coolant channel in such a way that a flow can pass therethrough. A rib is provided in the coolant channel. The advantage of the rib can be seen in an improved distribution of the coolant, in particular if the rib is formed opposite the opening point. The improved distribution of the coolant in the coolant channel, which can be further increased by virtue of the fact the rib is formed in each case opposite both the first opening point and the second opening point, can increase a cooling performance of the coolant. What is also advantageous by reason of the improved cooling performance of the coolant is that considerably reduced thermal stresses occur in the bearing section by reason of more homogeneous temperatures. This in turn is conducive for increasing the service life of the bearing section and thus of the exhaust turbocharger having the bearing section.

In order to further improve the cooling performance, the rib has a rib surface which is curved in a flow-optimized manner. The rib surface corresponds to the surface of the rib which faces the opening point and is formed closest thereto. Therefore, there is no problem of a break in flow when the coolant enters the coolant channel. If also the rib provided in the region of the outlet channel has a rib surface which is curved in a flow-optimized manner, this serves for irrotational discharge of the coolant.

In a further embodiment, the rib has a trapezoidal cross-section, whereby the cooling performance can be further increased by avoiding having locations in the coolant channel, through which no flow passes, in particular in the region of the inlet channel. Depending upon the speed of the coolant, in the case of a rectangular cross-section of the rib, a coolant-free location can be promoted in the region of the rib if the coolant impinges at a corresponding speed upon the rib surface and flows off with an aerodynamic trajectory on both sides of the rib surface.

A further increase in the coolant power can be achieved with a rib which has a rib wall, wherein a transition is formed between the rib wall and a coolant channel bottom, said transition being curved.

An additional increase in coolant power can be achieved if the opening point has a flow-optimized, curved circumferential edge.

In a further embodiment, the cooling jacket is provided with the aid of a dead mold. Therefore, the cooling jacket can be completely integrated in the bearing section and no leakages occur.

The second aspect of the disclosure relates to an exhaust turbocharger comprising the improved bearing section. The advantage can be seen in the fact that, by reason of the improved bearing section, of which the cooling performance is increased in comparison with the prior art, at the same exhaust gas temperatures a substantially longer service life of the exhaust turbocharger can be achieved or if the service life of the exhaust turbocharger is sufficient, exhaust gas can be supplied to the exhaust turbocharger at higher combustion temperatures. This in turn can result e.g. in an increase in the performance of the internal combustion engine.

Further advantages, features and details will be apparent from the following description of preferred exemplified embodiments and with reference to the drawing. The features and combinations of features mentioned earlier in the description and the features and combinations of features mentioned hereinunder in the description of the figures and/or illustrated individually in the figures can be employed not only in the combination stated in each case but also in other combinations or on their own. Like or functionally identical elements are allocated identical reference signs.

DETAILED DESCRIPTION

Figure 1:
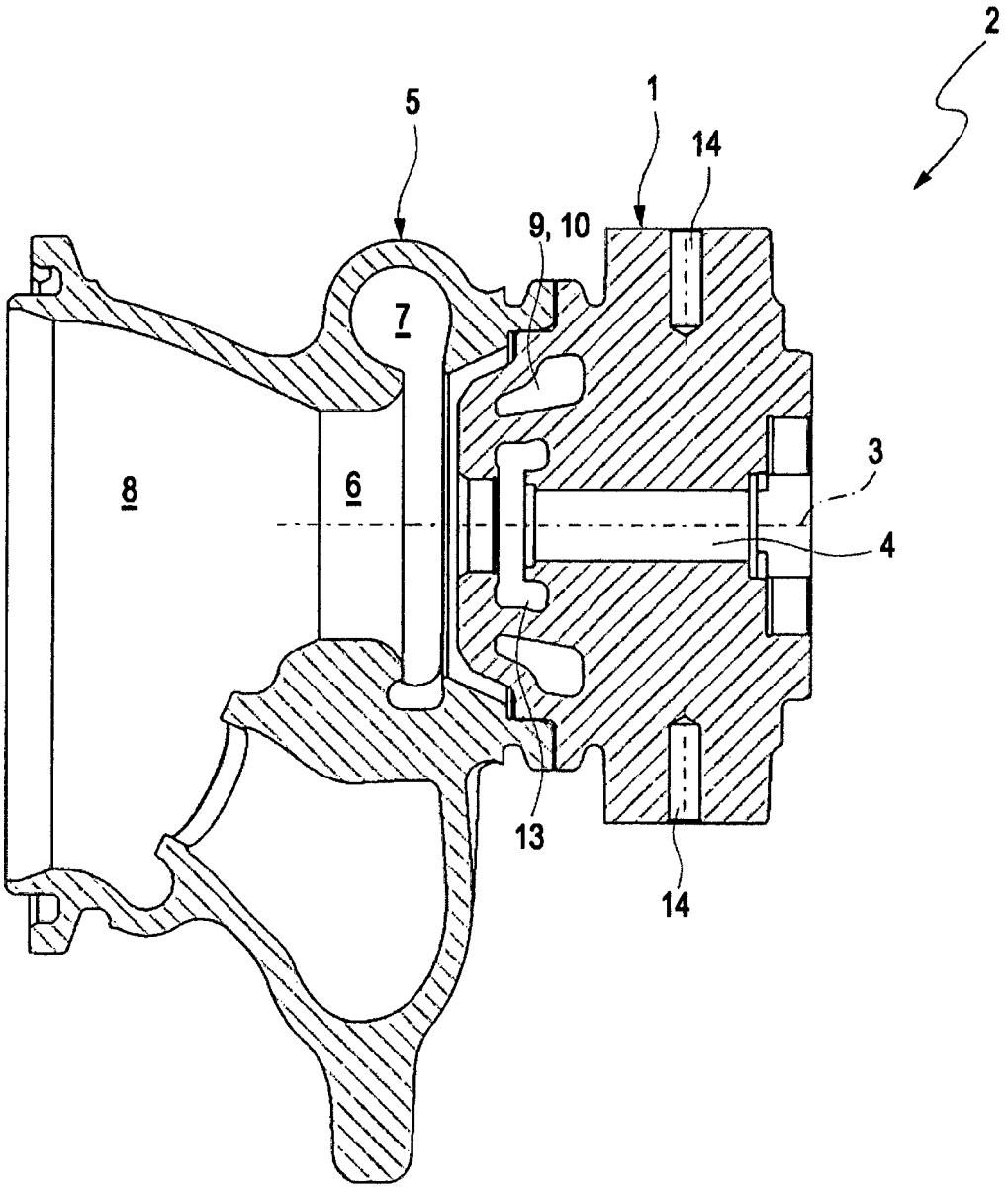
FIG. 1 shows a longitudinal sectional view of a bearing section and an exhaust gas conducting section of an exhaust turbocharger.

A bearing section 1—designed as shown in FIG. 1—of an exhaust turbocharger 2 comprises a receiving opening 4, which extends along a longitudinal axis 3, for receiving a shaft, not illustrated in greater detail, of a rotor assembly, not illustrated in greater detail. The receiving opening is also designed to receive bearing elements, not illustrated in greater detail, supporting the shaft. The bearing elements are lubricated with the aid of a lubricant which flows through the bearing section and which can flow into the bearing section 1 and out of the bearing section 1 via a lubricant circuit 13.

The bearing section 1 is arranged adjoining an exhaust gas conducting section 5 of the exhaust turbocharger 2. The exhaust gas conducting section 5 is designed to receive a turbine wheel, not illustrated in greater detail, of the rotor assembly in a wheel chamber 6. The wheel chamber is formed downstream of a spiral channel 7 of the exhaust gas conducting section 5, wherein the spiral channel 7 is configured such that a flow can pass therethrough with the wheel chamber 6. Formed upstream of the spiral channel is an inflow channel, not illustrated in greater detail, of the exhaust gas conducting section 5 which is provided for the entry of a fluid into the exhaust gas conducting section 5, in general exhaust gas of an internal combustion engine, not illustrated in greater detail. Arranged downstream of the wheel chamber 6 is an outlet channel 8 which is connected to the wheel chamber 6 such that a flow can pass therethrough.

The exhaust gas conducting section 5 is connected to an internal combustion engine, not illustrated in greater detail, so that the exhaust gas of the internal combustion engine can enter into the spiral channel 7 via the inlet channel in order to act upon the turbine wheel. During operation of the internal combustion engine, the component temperature of the exhaust gas conducting section increases by reason of the exhaust gas flowing therethrough. During operation of the internal combustion engine, the bearing section 1 likewise has an increased component temperature because it is formed adjoining the exhaust gas conducting section 5 and therefore is acted upon indirectly by the hot exhaust gas mass flow.

The bearing section 1 is cooled by a cooling jacket 9 which is designed such that it at least partially encompasses the receiving opening 4. The cooling jacket 9 is positioned for cooling in particular the bearing, in particular a radial bearing in the form of a slide bearing, located in proximity to the exhaust gas conducting section 5.

The cooling jacket 9 comprises not only a fully formed, i.e. in other words a circular, coolant channel 10 but also an inlet channel 11 and an outlet channel 12, wherein both channels 11, 12 are connected to the coolant channel 10 such that a flow can pass therethrough. The inlet channel 11 is provided for introducing the coolant into the coolant channel 10. The outlet channel 12 serves to discharge the coolant which, after being heated, can be supplied to a cooling circuit, in which it is then cooled to its cooling temperature as it enters via the inlet channel 11.

In order to fasten attachment elements, not illustrated in greater detail, for entry of the coolant into the inlet channel 11 or for exit of the coolant via the outlet channel 12, the bearing section 1 has in each case a fastening element 14 in the form of a bore.

Figure 2:
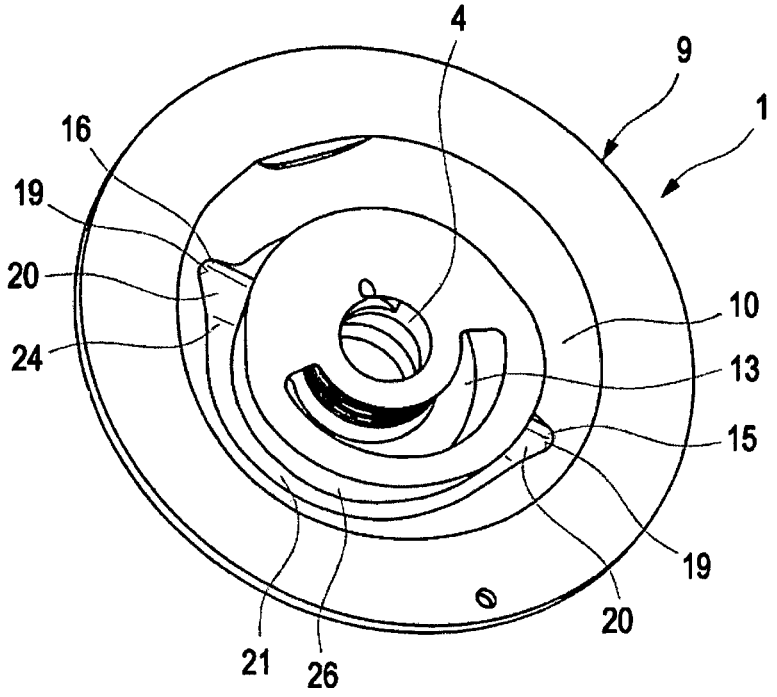
FIG. 2 shows a perspective sectional view of the bearing section.

FIG. 2 illustrates the bearing section 1 in a perspective sectional view in a cross-section, wherein it is illustrated in the viewing direction of the exhaust gas conducting section 5. The coolant channel 10 has a first rib 15 and a second rib 16 which are arranged opposite one another. The ribs 15, 16 are arranged at an opening point of the inlet channel 11 and the outlet channel 12 respectively. In other words, this means that between the inlet channel 11 and the coolant channel 10 a first opening point 17 is formed, opposite which downstream the first rib 15 is arranged, and between the outlet channel 12 and the coolant channel 10 a second opening point 18 is formed, opposite which upstream the second rib 16 is arranged.

Each rib 15, 16 is curved in a flow-optimized manner, wherein a rib surface 19 opposite the opening points 17, 18 is curved as is a transition 24 between rib walls 20 and a coolant channel bottom 21. Furthermore, each rib 15, 16 has a trapezoidal cross-section 25.

Figure 3:
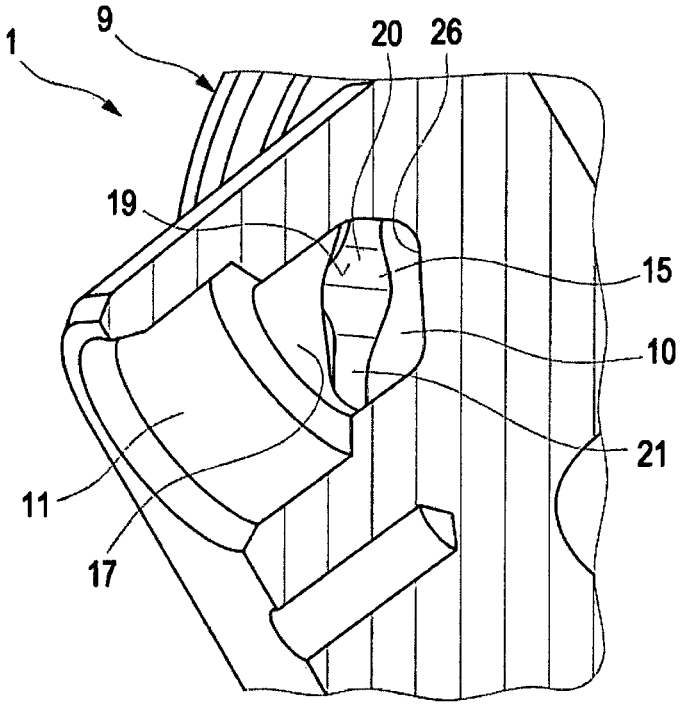
FIG. 3 shows a perspective sectional view of a detail of the bearing section in the region of a cooling water inlet.

FIG. 3 illustrates a perspective sectional view of a detail of the bearing section 1 in the region of the coolant inlet, wherein the inlet channel 11 is illustrated in section. It is particularly apparent from FIG. 3 that the first rib 15 is arranged opposite the first opening point 17 which connects the inlet channel 11 to the coolant channel 10 such that a flow can pass therethrough.

Figure 4:
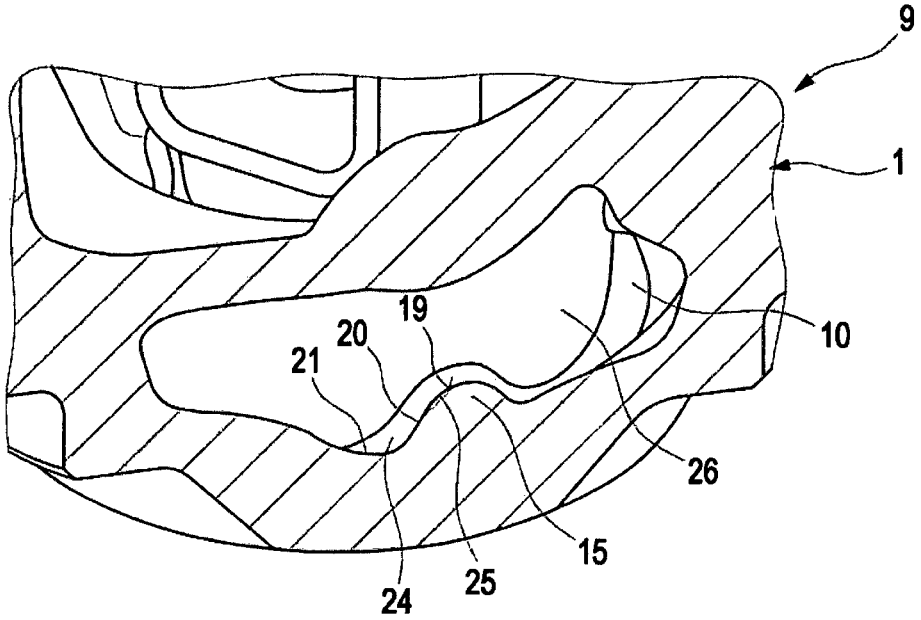
FIG. 4 shows a perspective sectional view of a detail of the bearing section in the region of a rib on the cooling water inlet.
Figure 5:
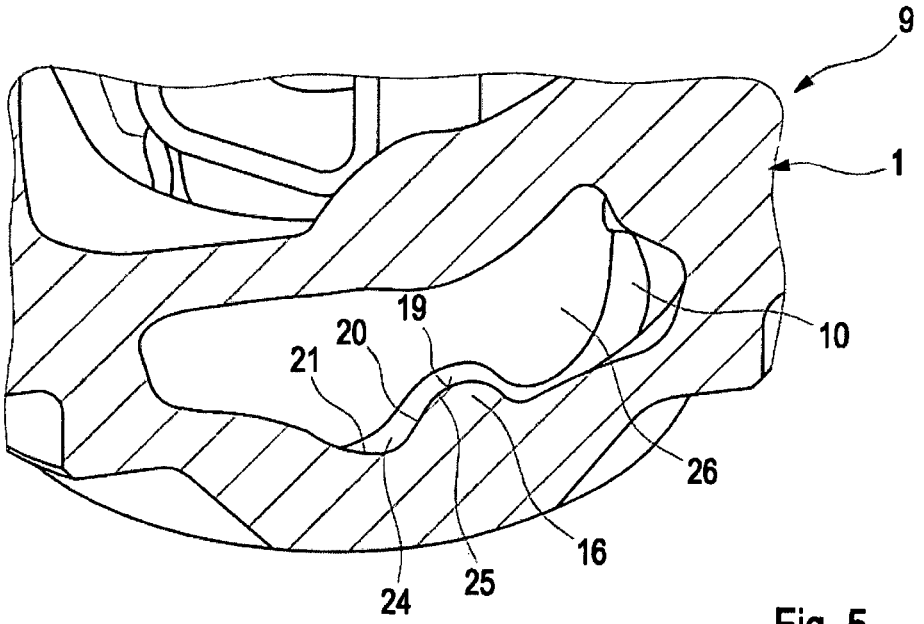
FIG. 5 shows a perspective sectional view of a detail of the bearing section in the region of a rib on a cooling water outlet.

FIGS. 4 and 5 illustrate exemplary flow threads of the coolant in the region of the first rib 15 and the second rib 16 respectively. Starting from the inlet channel 11, the coolant is guided onto a wall 26 of the coolant channel 10, wherein it is divided into two parts with the aid of the first rib 15. This promotes a continuous inflow of coolant into the coolant channel 10 without the creation of any turbulence. Likewise, the coolant can be diverted out of the coolant channel 10 in an improved manner with the aid of the second rib 16.

Figure 6:
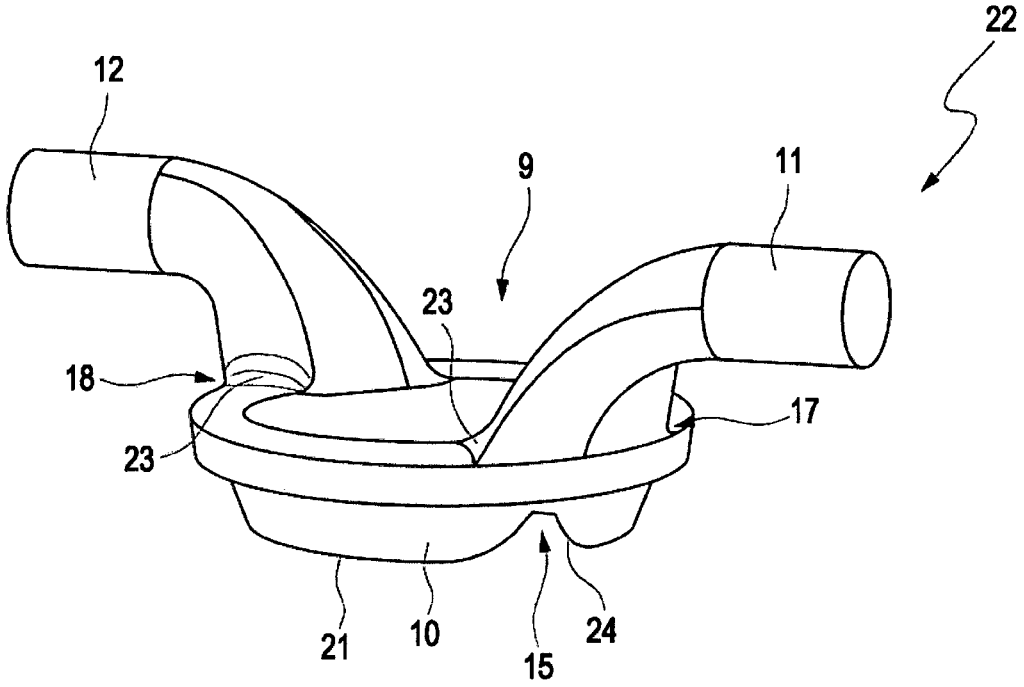
FIG. 6 shows a perspective view of a core of a water jacket of the bearing section.

The coolant 9 is produced in the form of a so-called dead mold, i.e. in other words with a core 22 which can be used only once because it is destroyed after cooling of the bearing section 1. FIG. 6 illustrates the core 22 for the cooling jacket 9, wherein the ribs 15, 16 are shown in the form of indentations. The core 22 is formed as a negative of the cooling jacket 9. For improved inflow and outflow of the coolant into and out of the coolant channel 10, the opening points 17, 18 are also provided in a flow-optimized manner with rounded circumferential edges 23 to ensure that no sharp edges which can be edges which break up a flow are formed.

The coolant channel 10 is to be designed so as to be adapted to the requirements of cooling the bearing section 1, wherein the position, height and radii of the ribs 15, 16 are to be configured in an optimized manner in terms of flow technology.

The invention claimed is:

1. A bearing section for an exhaust turbocharger, comprising a receiving opening (4) for receiving a shaft of a rotor assembly of the exhaust turbocharger (2), wherein the bearing section (1) is configured for positioning bearing elements for supporting the shaft, wherein a lubricant circuit is configured for supplying lubricant to the bearing elements, wherein lubricant channels are formed in the bearing section (1), wherein, in order to reduce a component temperature of the bearing section (1), a cooling jacket (9) is provided, through which a coolant can flow, wherein the cooling jacket (9) formed in the bearing section (1) comprises a circular coolant channel (10) formed in the bearing section (1), an inlet channel (11) for the coolant; which is connected in the bearing section (1) to the cooling jacket (9), and an outlet channel (12) for the coolant which is connected in the bearing section (1) to the cooling jacket (9), wherein the inlet channel (11) is connected to the coolant channel (10) at a first opening point (17), which is formed in the bearing section (1), and wherein the outlet channel (12) is connected to the coolant channel (10) at a second opening point (18), which is formed in the bearing section (1), and wherein a first rib (15) is provided in the coolant channel (10) opposite the first opening point (17) to divide the coolant entering through the inlet channel (11) into a first part flowing through a first side of the coolant channel and a second part flowing through a second side of the circular coolant channel, and wherein a second rib (16) is arranged opposite the second opening point (17) at which the first part of the coolant and the second part of the coolant are combined to exit the coolant channel (10) through the outlet channel (12).

2. The bearing section as claimed in claim 1, wherein the rib (15; 16) has a curved rib surface (19).

3. The bearing section as claimed in claim 1, wherein the rib (15; 16) has a trapezoidal cross-section.

4. The bearing section as claimed in claim 1, wherein the rib (15; 16) has a rib wall (20), and wherein a transition (24) is formed between the rib wall (20) and a coolant channel bottom (21), said transition being curved.

5. The bearing section as claimed in claim 1, wherein the opening point (17; 18) has a curved circumferential edge (23).

6. The bearing section as claimed in claim 1, wherein the cooling jacket (9) is produced with the aid of a dead mold.

7. An Exhaust turbocharger comprising a bearing section for receiving a rotor assembly of the exhaust turbocharger, wherein the bearing section is configured as claimed in claim 1.

* * * * *